US005419173A

United States Patent [19]

Baensch et al.

[11] Patent Number: 5,419,173

[45] Date of Patent: May 30, 1995

[54] FORWARD FEED GEAR MECHANISM FOR A COLD PILGER ROLLING MILL

[75] Inventors: Michael Baensch; Klaus Rehag, both of Mönchengladbach, Germany

[73] Assignee: Mannesmann Aktiengesellschaft, Mannesmannufer, Germany

[21] Appl. No.: 133,558

[22] Filed: Oct. 7, 1993

[30] Foreign Application Priority Data

Oct. 7, 1992 [DE] Germany ..... 42 34 394.1

[51] Int. Cl.[6] ..... B21B 21/04

[52] U.S. Cl. ..... 72/214; 72/249

[58] Field of Search ..... 72/214, 249

[56] References Cited

U.S. PATENT DOCUMENTS 4,577,483 3/1986 Rehag et al. ..... 72/214

FOREIGN PATENT DOCUMENTS 2424907 12/1974 Germany ..... 72/214

*Primary Examiner*—Lowell A. Larson

*Assistant Examiner*—Thomas C. Schoeffler

*Attorney, Agent, or Firm*—Cohen, Pontani, Lieberman, Pavane

[57] ABSTRACT

A forward feed gear mechanism for a cold pilger rolling mill having at least one forward feed slide, whose advancing movement can be derived from at least one forward feed spindle which is driven in continuous rotation, and an oscillating axial movement can be superimposed on the rotational movement of the forward feed spindle so that the gear mechanism is flexible and adaptable to different settings and provides high acceleration values with a simplified gear unit design. A planetary rolling spindle is provided for generating the axial movement of the forward feed spindles and is coaxially connected with one end of the forward feed spindle so as to be independently rotatable. The housing of the rolling spindle is rigidly arranged in the forward feed gear mechanism housing and the planetary rolling spindle can be driven in rotation in a translatory manner by a separate drive via a spur gear unit stage.

4 Claims, 3 Drawing Sheets

(A-B)

FORWARD FEED GEAR MECHANISM FOR A COLD PILGER ROLLING MILL

BACKGROUND OF THE INVENTION

1. Field of the Invention

The invention relates to a forward feed gear mechanism for a cold pilger rolling mill having at least one forward feed carriage or slide, whose feed movement can be derived from at least one forward feed spindle which is driven in continuous rotation. It also being possible to superimpose an oscillating axial movement on the rotational movement of the forward feed spindle.

2. Description of the Prior Art

In cold pilger rolling of pipes, the pipe to be rolled is incrementally rotated and advanced synchronously with the movement of the roll stand. Between these movements, the pipe is generally held securely and does not move. Mechanical gear units which are driven by the roll stand drive are conventionally used to produce the rotating and forward feed movement. Cold pilger rolling mills are also known in which the mechanical gear units are replaced by electric or hydraulic servodrives to produce the stepwise rotational and forward feed movements. These servodrives were moved according to defined settings as a function of the roll stand drive.

A forward feed gear mechanism of the type described above is known e.g. from DE-OS 21 16 604. In this prior art, the rotational movement of the forward feed spindle for the two forward feed slides is derived from the drive of the roll stand. A costly spur gear unit is used for this purpose. A translatory axial movement is superimposed on the continuous rotational movement of the forward feed spindle in that a disk cam gear mechanism causing a reciprocating movement of the forward feed spindle via a system of levers is set in motion by the same drive. When the gear mechanism is adapted in a corresponding manner, the rotational movement of the forward feed spindle and its oscillating axial movement are added or subtracted for advancing or stopping the forward feed slide.

Such mechanical forward feed gear mechanisms are costly and prone to wear and the possibilities for adaptation are limited. Thus, in the past, forward feed gear mechanisms employing separately adjustable electric or hydraulic servodrives were frequently used.

Particularly in electric servodrives for generating forward feed movement, definite restrictions had to be submitted to with respect to the attainable forward feed values. The electric forward feed drives which were used moved the output-drive or power take-off members directly, i.e. the speed at the power take-off was always directly proportional to the speed of the drive motor. Thus, the entire output for generating movement had to be applied by the servodrives so that very narrow limits on forward feed had to be accepted.

Since the advancing or forward feed movement is not reversible, but always progresses in the same direction, the maximum speed range of the servodrives could never be fully utilized. However, the servodrives had to absorb the full load moment. The proportion of motor torque available for acceleration was therefore unnecessarily small so that achievable forward feed values were reduced by external loads (back-rolling forces) conditioned by technical factors relating to the apparatus. Since the spindles engaging with the forward feed slide are rotated in a jerky manner in forward feed servodrives, this rotation requires large acceleration moments which negatively influence the achievable forward feed values.

The gear unit stages between the servomotor and spindle must be designed with a view toward a best possible acceleration. In general, this results in large transmission ratios, i.e. high motor speeds with low spindle speeds. The gear unit stages which are selected in this way automatically condition a lengthy returning movement of the forward feed slide to its initial position even when the servomotor reverses at maximum speed. This represents a significant loss of production time for the operator.

SUMMARY OF THE INVENTION

Accordingly, it is an object of the present invention to improve a forward feed gear mechanism for a cold pilger rolling mill of the type mentioned above so that it is flexible and adaptable to different settings, on the one hand, and, on the other hand, provides high acceleration values with a simplified gear unit design.

Pursuant to this object, and others which will become apparent hereafter, one aspect of the present invention resides in providing a planetary rolling spindle, known per se, for generating the axial movement of the forward feed spindle and connected with one end of the forward feed spindle coaxially thereto so as to be independently rotatable. The housing of the planetary rolling spindle is rigidly arranged in the forward feed gear mechanism housing and the planetary rolling spindle can be driven in rotation in a translatory manner by a separate drive via a spur gear unit stage.

In the conventional drive of the forward feed spindle derived from the drive of the roll stand or separately driven by hydraulic or electric drives, the invention consists in providing a novel drive for the translatory axial movement of the forward feed spindle. The planetary rolling spindle, which is a known machine element, is used for this purpose, i.e. the translatory drive of the forward feed spindle is produced by means of the axial movement of the planetary rolling spindle which is rotated in its housing. This planetary rolling spindle is thus connected with the end side of the forward feed spindle in such a way that it can execute axial movements with the forward feed spindle and the forward feed spindle can execute axial movements with the planetary rolling spindle, but an independent rotation of the two spindles is possible. In order to rotate the planetary rolling spindle and accordingly achieve its axial movement, this planetary rolling spindle is provided with a separate drive which drives the planetary rolling spindle in both rotational directions with the intermediary of a spur gear unit stage. In so doing, the separate drive enables a complete freedom of adjustment of the spindle lift without causing the disadvantages described above with respect to the direct drive of the forward feed spindle by means of servomotors.

A servomotor which corresponds with a worm wheel of the spur gear unit stage via a worm is preferably provided for the drive of the planetary rolling spindle. The servomotor can be controlled in both rotating directions. The servomotor runs "backward" when the rough-pierced pipe is stopped. During the forward feed phase it changes rotational direction and accelerates to a positive maximum speed so that the full speed range can be made use of in extreme cases. This advantage is particularly important in high-output servomotors, since the latter often have a very low maximum speed.

A particular advantage of the invention consists in that the total output which may be applied for the forward feed drive is divided between at least two drives. The continuous rotational drive of the forward feed spindle can likewise be effected via one or more servomotors. As suggested by the invention, the servomotor for the translatory axial movement is extensively relieved of the torque transmitted into the forward feed spindle by the rolling force. These forces are absorbed by the rotational drives of the forward feed spindle themselves.

According to another embodiment of the invention, at least one toothed wheel of the spur gear unit stage has a width which is adapted to the axial lift of the forward feed spindle. As a result of this, the spur gear unit stage remains engaged in every axial position of the planetary rolling spindle.

In a further embodiment of the invention, an axial bearing absorbing the axial forces from the rolling process is arranged between the forward feed spindle and the planetary rolling spindle. It is advantageous that the planetary rolling spindle is capable of absorbing the back-rolling forces transmitted by the forward feed spindle via the axial beating. The torque produced by these forces in the spindle can be controlled substantially better than if the forward feed spindle were rotated directly by the servomotor. The forces ultimately reaching the servomotor are very small as a result of this construction. The servomotor is accordingly not loaded to such a great extent by the rolling forces and can make a greater proportion of its torque available for accelerating the forward feed slide.

Since the forward feed spindles of the slide are accelerated in a translatory manner, less power is required than if the spindles were accelerated in direct rotation by the servomotors. Nevertheless, the range of variation in the adjustment of the forward feed compared to the costly solution using the disk cam is maintained.

The reverse running of the forward feed slide can also be improved by uncoupling the servomotor executing the translatory axial movement of the forward feed spindle from the rotating drives for the continuous movement of the forward feed spindle. The gear mechanism producing the translatory axial movement is not decisive for the reverse running speed. This gear mechanism can accordingly be designed optimally with respect to the requirements of the accelerating drive without the reverse running speed of the slide being impaired by the gear mechanism as described above.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
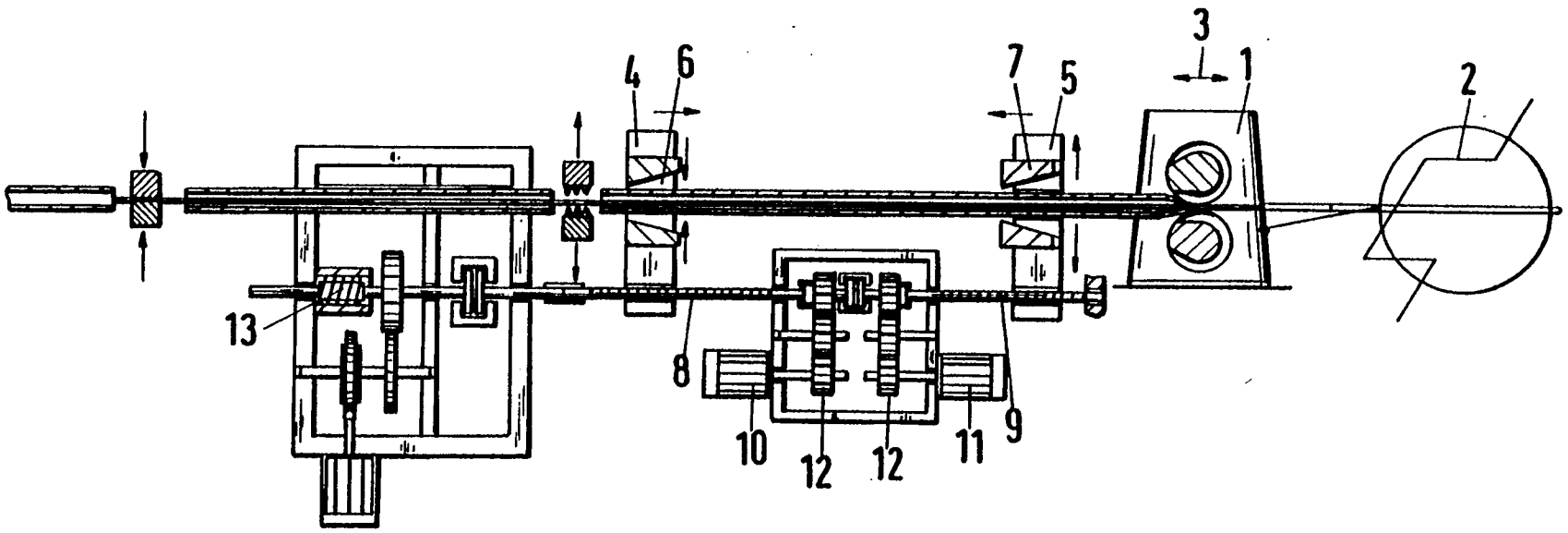
FIG. 1 shows a forward feed gear mechanism according to the invention in a roughly schematic manner.

In FIG. 1, the roll stand of the cold pilger rolling mill is designated by 1. This roll stand 1 is reciprocated in the direction of arrow 3 by a crank drive 2. The forward feed slides 4, 5 alternately engage the pipe with their clamping devices 6, 7 and advance it by a forward feed lift as soon as the roll stand 1 passes through the dead center position. The forward feed slides 4, 5 are driven continuously via the forward feed spindles 8, 9. The spindles 8, 9 are controllable independently from one another and in their rotational direction so that the forward feed slide 4 or 5 which is not engaged with the pipe can move back to its initial position, while the other forward feed slide takes over the forward feed of the pipe. In the embodiment shown in the drawing, the two forward feed spindles 8, 9 can be driven by separate motors 10, 11 via spur gear mechanisms 12.

An oscillating translational movement generated by a planetary rolling spindle 13 is superimposed on the forward feed spindles 8, 9. In this respect, reference is made to FIG. 2.

Figure 2:
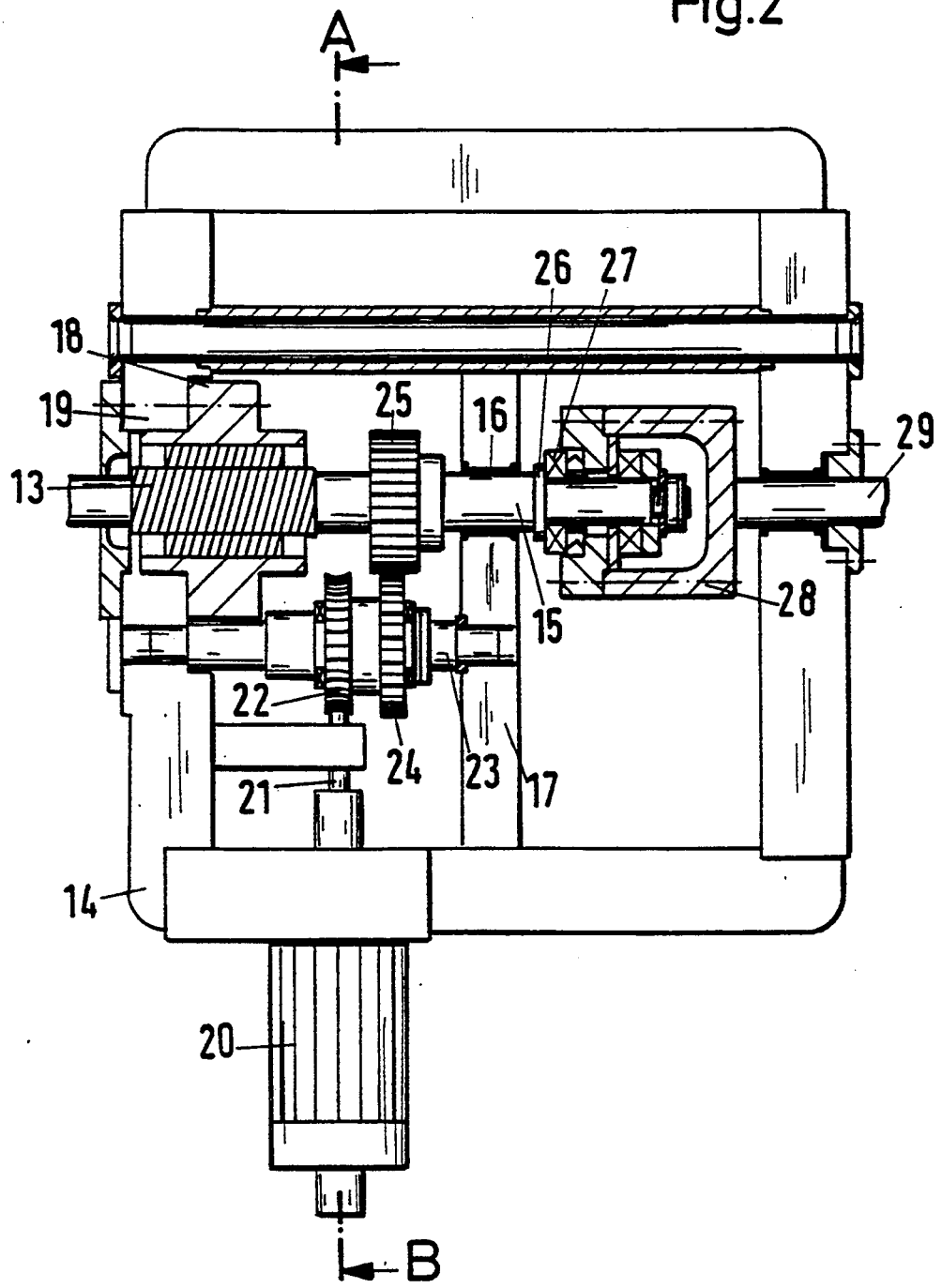
FIG. 2 is a view in longitudinal section of the portion of the forward feed gear mechanism effecting the translatory axial movement.

In FIG. 2 the housing of the gear part according to the invention is designated by 14. The spindle shaft 15 of the planetary rolling spindle 13 is supported in the housing 14 at a bearing 16 in a center wall 17, while the spindle shaft 15 carrying the planetary rolling spindle 13 is supported in the housing 18 of the planetary rolling spindle 13. The housing 18 is rigidly fastened at the point 19 to the housing 14 of the gear part so as to permit a rotation of the planetary rolling spindle with a simultaneous axial movement. The servomotor 20 is provided for producing the rotation of the spindle shaft 15. The servomotor 20 is connected with a worm wheel 22 by a worm shaft 21 which it rotates, the worm wheel 22 being arranged coaxially on a shaft 23 with a spur gear 24. The spur gear 24 meshes with a spur gear 25 which is fastened to the spindle shaft 24 so as to be fixed with respect to rotation relative to it. To ensure that the spur gear combination 24, 25 remains engaged during the axial movement of the spindle shaft 15 occurring during the rotation of the planetary rolling spindle, the spur gear 25 has a tooth width which is designed so as to correspond to the lift width. The bearing 16 of the spindle shaft 15 is constructed as a sliding bearing and also enables the axial movement of the spindle shaft.

The end of the spindle shaft 15 remote of the planetary rolling spindle is provided with a collar 26 against which an axial bearing 27 is supported. The forward feed spindle 29 is connected with the spindle shaft 15 via a connecting member 28 so as to be supported by the axial bearing 27. The connection is constructed so that the spindle shaft 15 and the forward feed spindles 8, 9 are fastened rigidly to one another in the axial direction, but an independent rotation is possible.

Figure 3:
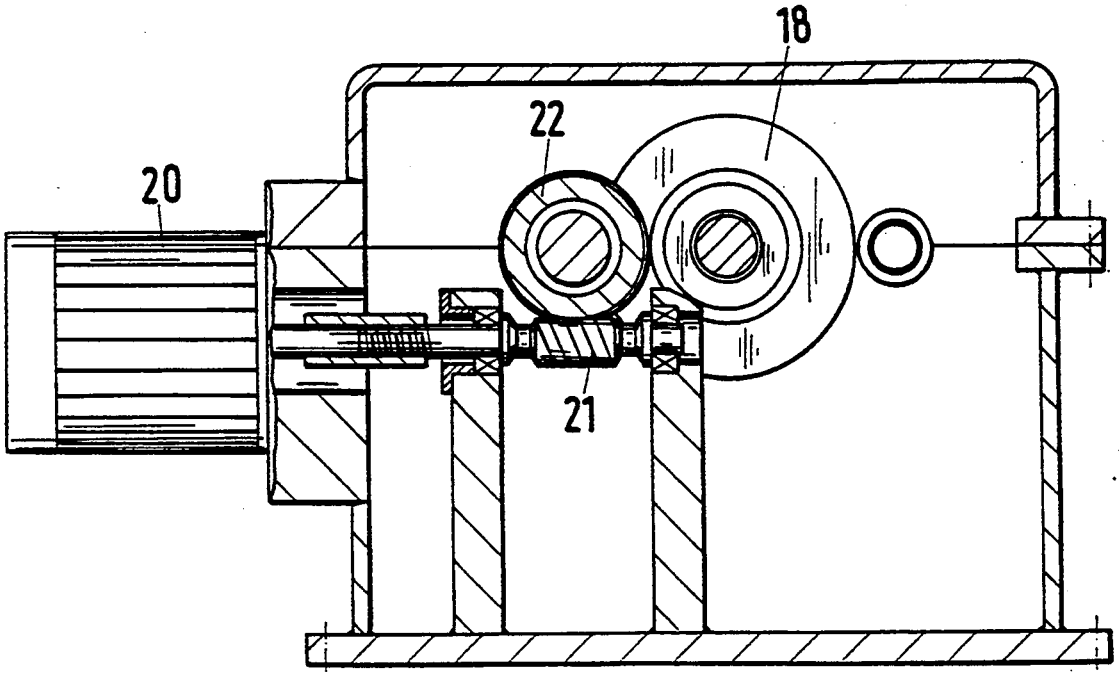
FIG. 3 shows section A-B in FIG. 2.

FIG. 3 shows the section A-B through the view shown in FIG. 2. Identical parts are provided with the same reference numbers.

The flow of operations will be described in the following with reference to FIG. 1. The roll stand 1 is reciprocated by the crank drive 2. In FIG. 1, the forward feed slide 4 has just engaged the pipe and the forward feed slide 5 has released the pipe. While the forward feed slide 5 travels back into its initial position in the direction of the arrow, the forward feed slide 4 advances the pipe in the forward feed direction. For this purpose, the forward feed spindles 8, 9 are driven by the forward feed motors 10, 11 in opposite directions with constant rotational movement. An oscillating translatory movement which is produced in the planetary rolling spindle is superimposed on the rotational movement of the forward feed spindles generating the forward feed. The servomotor 20 is driven in rotation and causes a rotation of the spindle shaft 15 of the planetary rolling spindle 13 via the worm shaft 21, the internal geared wheel 22, and the toothed gear combination 24, 25 so that this planetary rolling spindle 13 screws in and out of the housing of the planetary rolling spindle. Since the spindle shaft 15 is axially connected at 28 with the forward feed spindle 8, 9, the forward feed spindle or spindles 8, 9 is/are moved axially insofar as the translatory axial movement and the rotational movement of the forward feed spindles are superimposed. When the servomotor 20 changes its rotating direction, the movement of the forward feed slide relative to the roll stand is stopped when the drives are so adapted, since the forward feed movement of the forward feed spindle 8 or 9 is compensated for by the axial movement of the planetary rolling spindle.

The invention is not limited by the embodiments described above which are presented as examples only but can be modified in various ways within the scope of protection defined by the appended patent claims.

We claim:

1. A forward feed gear mechanism for a cold pilger rolling mill having at least one forward feed slide with an advancing movement derived from at least one forward feed spindle that is continuously rotated, the forward feed gear mechanism comprising:

a housing for the gear mechanism;

a planetary rolling spindle provided so as to generate and superimpose an oscillating axial movement on rotation of a forward feed spindle, the planetary rolling spindle being coaxially connected with one end of the forward feed spindle so as to be rotatable independently from the forward feed spindle;

a housing for the planetary rolling spindle rigidly arranged in the housing for the gear mechanism; and separate drive means including a spur gear unit stage for driving the planetary rolling spindle in rotation in a translatory manner.

2. A forward feed gear mechanism for a cold pilger rolling mill according to claim 1, wherein the spur gear unit stage includes a worm wheel, the drive means for the planetary rolling spindle including a servomotor and a screw provided so as to interconnect the worm wheel and the servomotor.

3. A forward feed gear mechanism for a cold pilger rolling mill according to claim 1, wherein the spur gear unit stage includes at least one toothed wheel that has a width adapted to an axial lift of the forward feed spindle.

4. A forward feed gear mechanism for a cold pilger rolling mill according to claim 1, and further comprising an axial bearing arranged between the forward feed spindle and the planetary rolling spindle so as to receive axial forces generated by a rolling process of the rolling mill.

* * * * *